United States Patent [19]

Kyriakou

[11] 4,289,149

[45] Sep. 15, 1981

[54] CIGARETTE PROTECTOR

[76] Inventor: George S. Kyriakou, 43-43 91st Pl., Elmhurst, N.Y. 11373

[21] Appl. No.: 136,521

[22] Filed: Apr. 2, 1980

[51] Int. Cl.[3] ..... A24F 7/02

[52] U.S. Cl. ..... 131/175; 131/187; 131/191; 131/198 R; 131/225

[58] Field of Search ..... 131/175, 178, 187, 189, 131/191, 198 R, 216, 225, 226

[56] References Cited

U.S. PATENT DOCUMENTS 1,821,267 9/1931 Loesch ..... 131/175

2,499,733 3/1950 Di Rubbio ..... 131/175

2,625,163 1/1953 Jones et al. ..... 131/175

*Primary Examiner*—V. Millin

*Attorney, Agent, or Firm*—Richard L. Miller

[57] ABSTRACT

A case for enclosing a cigarette while being smoked, in order to prevent ashes from scattering therefrom; the case including an outer tube fitted with a removable mouthpiece bit and end cap at opposite ends thereof, the end cap being integral with an inner tube spaced from the outer tube and also from a cigarette fitted at one end in a bit and both tubes being perforated so to admit air to the cigarette flame.

1 Claim, 4 Drawing Figures

CIGARETTE PROTECTOR

BACKGROUND OF THE INVENTION

This invention relates generally to cigarette holders. It is well known that while being smoked, a cigarette develops an ash, which if not frequently knocked off therefrom, is liable to fall off itself from its own weight when becoming too big, so that it will soil clothing, carpets or other objects that it falls thereupon. The end of the ash nearest the flame may also include glowing coals of burning tobacco which are dangerous because if they fall undetected upon some burnable object, they may start a fire, such as has happened many times in the past, such as for example by drowsy smokers smoking in bed. This situation which has resulted in numerous burning of homes and also in fatalities and it accordingly is in need of an improvement.

SUMMARY OF THE INVENTION

Therefore it is a principal object of the present invention, to provide a cigarette protector that encloses a burning cigarette and prevents ashes and glowing coals from falling therefrom upon any combustible object.

Another object is to provide a cigarette protector which accordingly will be particularly ideal for persons who smoke while they are sleepy or who smoke while in bed.

Yet a further object is to provide a cigarette protector which in no way detracts from the pleasure of smoking, and which will additionally aid in maintaining a lighted cigarette out-of-doors in a high wind or during a drenching rain by shielding the flame therefrom.

Yet another further object is to provide a cigarette protector which can be manufactured in a size so as to be suitable for use on cigars, with the same advantages thereto.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF PREFERRED EMBODIMENT

Figure 1:
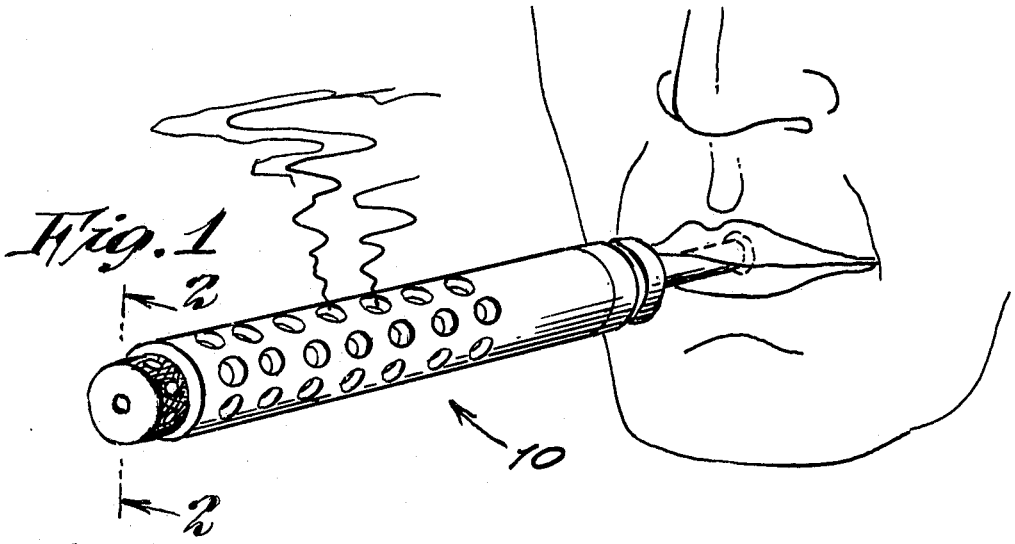
FIG. 1 is a perspective view of the invention, shown in use by a person smoking a cigarette.
Figure 2:
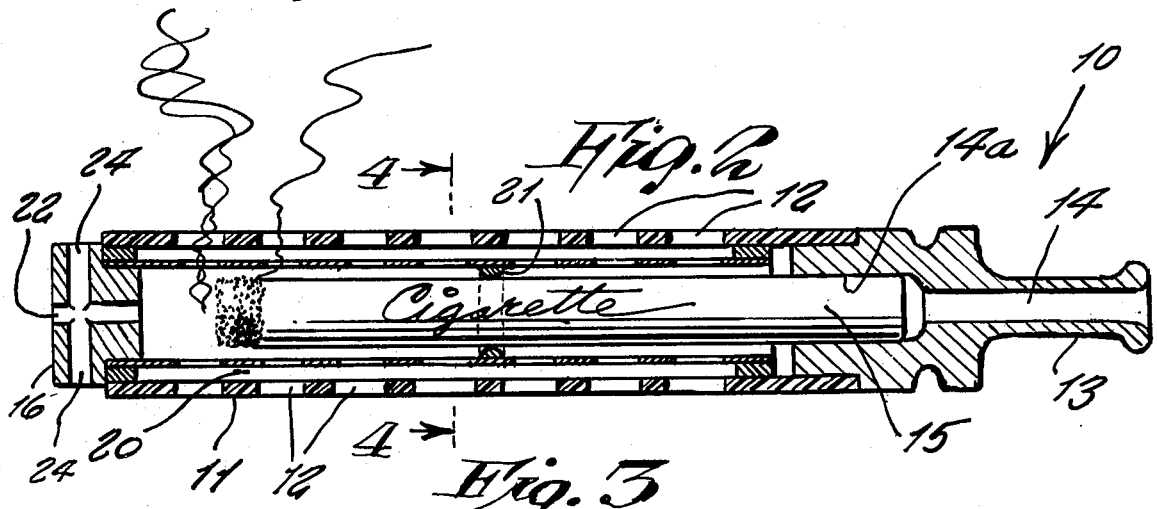
FIG. 2 is a side cross sectional view taken on line 2—2 of FIG. 1.
Figure 3:
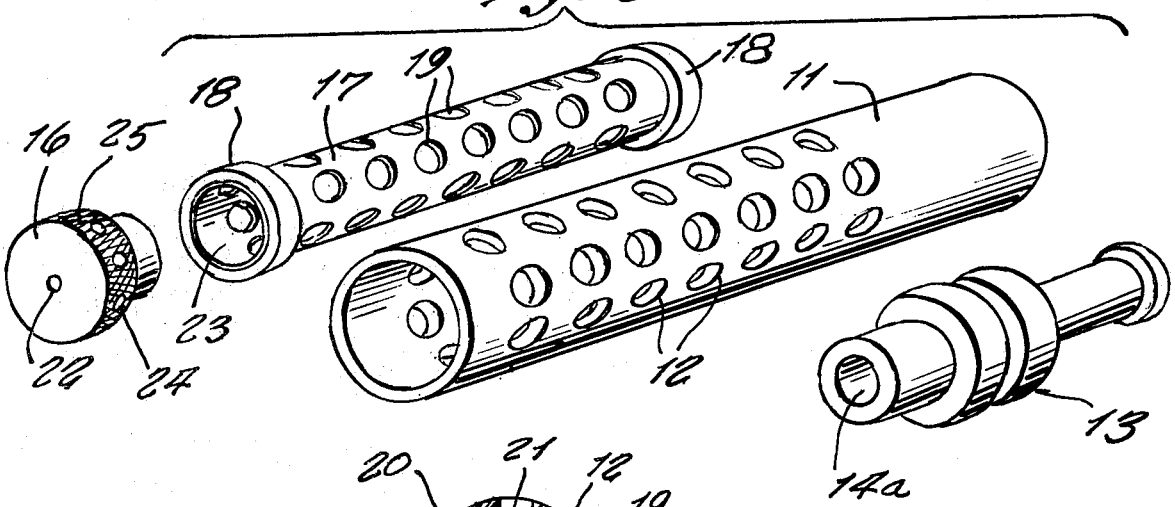
FIG. 3 is an exploded perspective view of the invention components.
Figure 4:
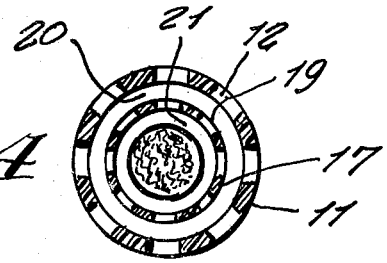
FIG. 4 is a cross sectional view taken on line 4—4 of FIG. 2.

Referring now to the drawing in greater detail, the reference numeral 10 represents a cigarette protector, according to the present invention, wherein there is an outer tube 11 made from a hard plastic. It includes a plurality of perforated openings 12 around its side.

A mouthpiece bit 13, molded of hard plastic, is fitted removably in one end of the tube, the bit including a hole 14 therethrough so as to allow drawing smoke therethrough. A wider end 14*a* of the hole 14 receives one end of a cigarette 15.

An opposite end of the tube 11 is fitted with a removable end cap 16 which fits in one end of an inner tube 17 fitted with spacer collars 18 therearound that fit inside the outer tube. The inner tube also includes perforated openings 19 therearound similarly to openings 12 in the outer tube. The end cap and inner tube are made of a non-combustible material such as a lightweight metal, so as to not be effected by a flame burning on an end of the cigarette.

A space 20 formed between the inner and outer tubes provides insulation therebetween, so that heat from the flame is not transmitted to the outer tube. A collar 18 around an outer side of the inner tube serves to maintain the space 20 a same distance all around the inner tube.

A ring 21 affixed on an inner side of the inner tube bear against the side of the cigarette so as to keep the flame from direct contact with the inner tube.

A hole 22 through a center of the end cap aligns with the center opening 23 of the inner tube. A series of radial holes 24 in the end cap communicate with the opening 23. The peripheral surface of the cap is knurlled as shown at 25 for providing a firm grasp in order to pull off the end cap.

In use, the lighted cigarette is thus protected from readily dropping hot coals.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A cigarette protector comprising an elongated inner tube having a series of perforations formed on the surface thereof and defining therein a hollow elongated cavity for reception therein of a cigarette, said perforations being in fluid communication with said hollow cavity, said inner tube having a first end and a second end spaced longitudinally from said first end; an outer elongated tube also having a series of perforations formed on the surface thereof and defining an elongated hollow cavity therein, said elongated outer tube having a diameter greater than the diameter of said inner tube for receiving therein said inner tube, said outer tube having a longitudinal length greater than the longitudinal length of said inner tube, said outer tube having a first end near said first end of said inner tube but spaced therefrom in a direction away from said second end of said inner tube, and a second end axially aligned with and coplanar with said second end of said inner tube, whereby when said inner tube is mounted within said outer tube, a hollow space exists between said first end of said inner tube and said first end of said outer tube which is defined by the inner surface of said outer tube; said inner tube having a pair of spacer collars, one said spacer collar being mounted at said first end of said inner tube, and the other of said spacer collars being mounted at said second end of said inner tube, whereby said inner tube is spaced from and aligned with said outer tube, said pair of spacer collars bearing against the inner circumferential surface of said outer tube; said inner tube further comprising an inner ring projecting from the inner circumferential surface of said inner tube and projecting into said hollow elongated cavity of said inner tube for positioning therein in a stable and firm manner a cigarette, said ring being positioned midway between said first and second ends of said inner tube; a mouthpiece having an elongated first portion having an axial opening formed therein, and a second portion of larger diameter than said first portion, said opening formed in said first portion extending part way into said second portion, said second portion also having formed therein an axial opening of larger diameter than said opening in said first portion, said second portion having a reduced end forming thereabout a shoulder for abuttment against said first end of said outer tube, said reduced portion having an outer diameter approximately equal to the inner diameter of said outer tube for snugly fitting said second portion of said mouthpiece in said first end of said outer tube, said larger diameter opening of said second portion receiving therein the end of a cigaretter adjacent said first end of said outer tube, said axial opening of larger diameter of said second portion extending from a first location within said hollow space between and spaced from said first ends of said inner and outer tubes and a second location beyond said first end of said outer tube in a direction away from the second end thereof; and a removable end cap mounted at said second end of said inner tube, said removable cap having an enlarged portion formed with an axial bore and a plurality of radial bores, and a reduced portion of smaller diameter than said enlarged portion to define therebetween a shoulder portion, said reduced portion fitting snugly within said hollow cavity of said inner tube at said second end thereof, and said shoulder portion abutting against the outward end surfaces of said second ends of said inner and outer tubes and said spacer collar positioned at said second end of said inner tube, said reduced portion also having an axial bore formed therein in alignment with said axial bore of said enlarged portion of said removable cap, whereby a cigarette burning in said inner tube is protected from causing damage to the surroundings.

* * * * *